US005127843A

United States Patent [19]

Henry et al.

[11] Patent Number: 5,127,843

[45] Date of Patent: Jul. 7, 1992

[54] INSULATED AND SHIELDED CONNECTOR

[75] Inventors: Randall R. Henry; Tracy L. Smith, both of Harrisburg, Pa.

[73] Assignee: AMP Incorporated, Harrisburg, Pa.

[21] Appl. No.: 816,781

[22] Filed: Jan. 2, 1992

Related U.S. Application Data

[63] Continuation of Ser. No. 530,384, May 30, 1990, abandoned.

[51] Int. Cl.[5] ..... H01R 13/658

[52] U.S. Cl. ..... 439/320; 439/610; 439/583

[58] Field of Search ..... 439/89, 98, 320-323, 439/578, 585, 610, 675

[56] References Cited

U.S. PATENT DOCUMENTS

| | | | |
|---|---|---|---|
| 3,281,756 | 10/1966 | O'Keefe et al. | 339/89 |
| 3,391,381 | 7/1968 | Livingston | 439/610 |
| 3,824,526 | 7/1974 | Glover | 439/320 |
| 3,842,390 | 10/1974 | Glover et al. | 439/98 |
| 4,154,496 | 5/1979 | Gallagher | 439/321 |
| 4,634,208 | 1/1987 | Hall et al. | 439/610 |
| 4,737,124 | 4/1988 | Ezure et al. | 439/610 |
| 4,737,362 | 8/1988 | Moji | 439/610 |
| 4,749,355 | 6/1988 | Hemmer | 439/63 |
| 4,781,622 | 11/1988 | Ratchford et al. | 439/585 |
| 4,790,765 | 12/1988 | Ehrenfels et al. | 439/98 |
| 4,804,339 | 2/1989 | Cohen | 439/80 |
| 4,869,690 | 9/1989 | Frear et al. | 439/675 |
| 4,887,971 | 12/1989 | Reuss et al. | 439/610 |

FOREIGN PATENT DOCUMENTS

| | | | |
|---|---|---|---|
| 2223892 | 4/1990 | United Kingdom | 13/46 |

OTHER PUBLICATIONS

MIL-C-3655/1B, Apr. 11, 1980, pp. 1401-1409, Military Specification Sheet—Connector, Plug, Electrical, Class I, (Coaxial, Series Twin), Type UG-421B/U.

*Primary Examiner*—Larry I. Schwartz
*Assistant Examiner*—Kevin J. Carroll
*Attorney, Agent, or Firm*—Gerald K. Kita

[57] ABSTRACT

A connector 1 comprising: conductive contact means 14 for connection to a corresponding signal conductor 3 of an electrical cable 2, a conductive shell, insulator means 15 for separating the contact means 14 and the conductive shell, an insulative housing 8 with a key 31 for orienting and covering the conductive shell 16 and the insulator means 15, and insulative coupling means 9 for disconnectable coupling to a complementary connector and adapted for movement along a portion of the insulative housing 8 with an interference fit therewith to a position for rotation with the insulative housing 8 while interlocked with a second portion of the insulative housing 8.

9 Claims, 3 Drawing Sheets

INSULATED AND SHIELDED CONNECTOR

This application is a continuation of application Ser. No. 07/530,384 filed May 30, 1990, now abandoned.

FIELD OF THE INVENTION

The invention relates to a shielded electrical connector providing EMI and RF shielding.

BACKGROUND OF THE INVENTION

A connector disclosed in U.S. Pat. No. 3,281,756 includes electrical contacts connected to corresponding signal carrying conductors of a cable, and a conductive shell connected to a conductive, outer braid or tubing providing a shield for EMI, electromagnetic interference and RF, radio frequency interference. The conductive shell is uncovered, and can transmit high voltage that is induced or conducted along the shield of the cable. Such high voltage can cause electrical shock to a person that grasps the conductive shell.

In a connector that has two electrical contacts, a keying feature is required to orient the contacts during mated connection of the connector to another, complementary connector. Heretofore, the keying feature was accomplished by machining a key unitary with the shell, or by assembling a separate key and the shell.

A further assembly operation is required for mounting a coupling mechanism to the connector, such that the coupling mechanism can be coupled to a complementary connector. Heretofore a coupling mechanism was retained on the connector by a ring assembled on an exterior of the connector as a separate component part.

SUMMARY OF THE INVENTION

According to the invention, a connector is assembled according to a method that eliminates a key on the shell and provides an insulative housing and insulative coupling means to eliminate the hazard of electrical shock.

Further according to the invention, a connector comprises, and is assembled according to a method involving assembly of, an insulative housing and a conductive shell fabricated by having been drawn.

Further according to the invention, a connector comprises, and is assembled according to a method involving assembly of, an insulative coupling means and an insulative housing having been molded with an integral key, and the coupling means is assembled by movement along a portion of the housing with an interference fit to a position for rotation with respect to the housing while interlocked with a second portion of the housing.

According to an aspect of the invention, a connector comprises, conductive contact means for connection to corresponding signal conductor means of an electrical cable, a conductive shell, insulator means for separating the contact means and the conductive shell, an insulative housing having a unitary key, respective keyways of the conductive shell and the insulator means receiving the unitary key, and the conductive shell is fabricated by having been drawn into the shape of a cylinder with the keyway extending longitudinally of the cylinder and opening into a front end of the cylinder.

According to another aspect of the invention, a connector is fabricated by a process comprising the steps of: assembling an insulative coupling means and a unitary insulative housing having been molded with a key, assembling a conductive shell into an opening of the housing with a keyway of the shell receiving the key, assembling into the opening insulator means and at least one electrical contact having been joined to a corresponding conductor of an electrical cable and a conductive clamp having been joined to a conductive shield of the cable, and covering the opening in the housing with an insulative cover.

The invention will now be described in the accompanying detailed description, by way of example, with reference to the accompanying drawings.

DETAILED DESCRIPTION OF THE INVENTION

Figures 1, 2:
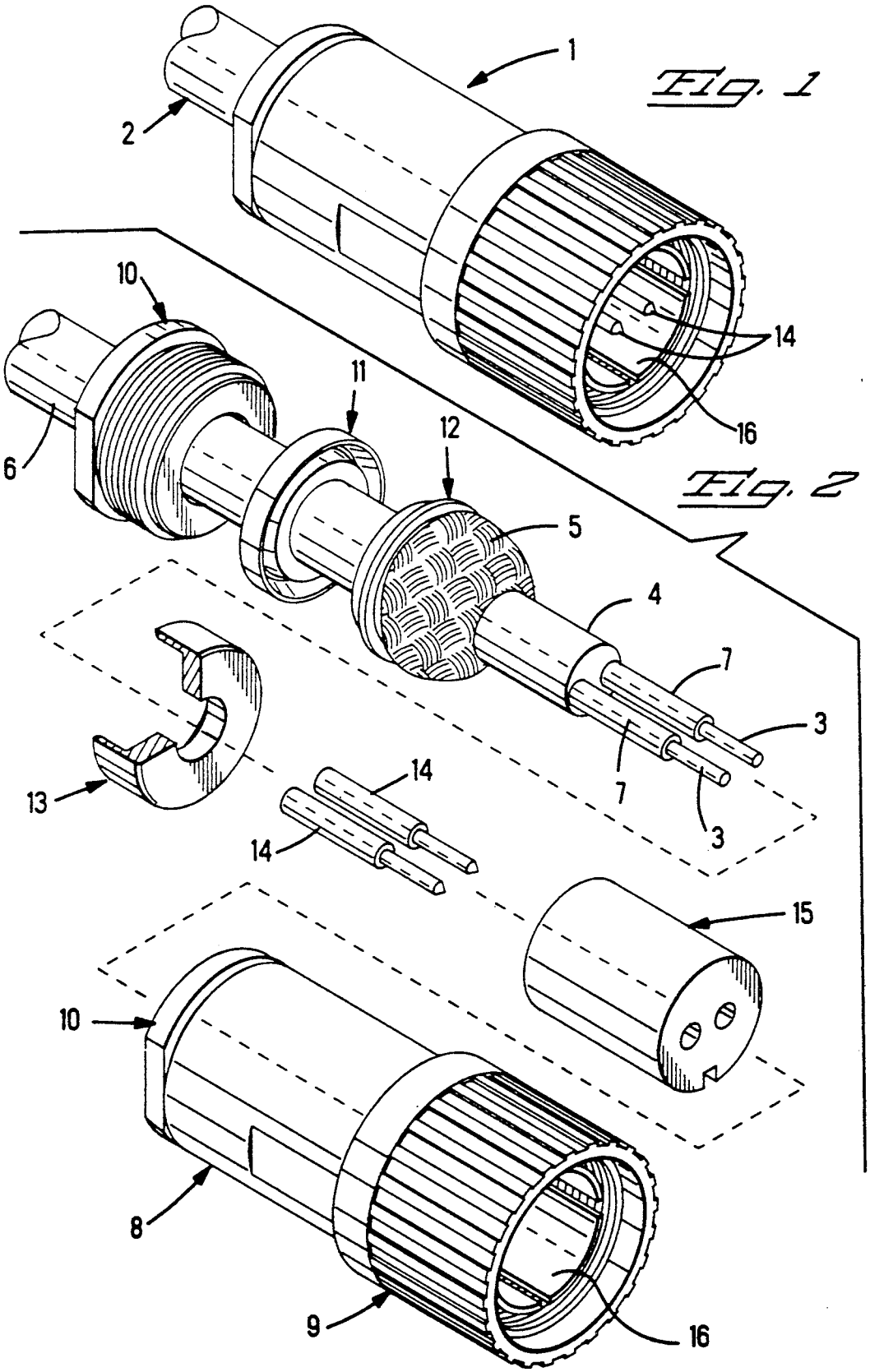
FIG. 1 is a perspective view of a connector assembled with an electrical cable.
FIG. 2 is a perspective view of the connector shown in FIG. 1 with parts exploded apart.

With reference to FIGS. 1 and 2, a connector 1 is assembled to an electrical cable 2. The cable 2 includes first and second elongated conductor means or conductors 3, 3 each encircled by insulation 4 known as the dielectric, a conductive shield 5, for example, braided wires encircling the dielectric 4, and an outer insulative jacket 6 of polymeric material. Insulation 7 may encircle a corresponding conductor 3.

The connector 1 and its component parts will now be explained. An insulative housing 8 and an insulative coupling means 9, for example, a tubular collar, provides outer insulative surfaces that prevent electrical shock from voltage transmitted along the shield 5 of the cable 2. Also shown is an insulative nut 10, a gasket 11, a conductive clamp element 12, a conductive sleeve element 13, conductive contact means, for example, electrical contacts 14, 14 of tubular form for receipt of and connection to the respective conductors 3 of the cable 2, insulator means 15, and a conductive shell 16, FIGS. 3 and 4.

Figure 13:
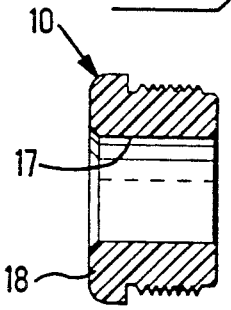
FIG. 13 is a side elevation view in section of an insulative nut of the connector shown in FIG. 1.
Figure 14:
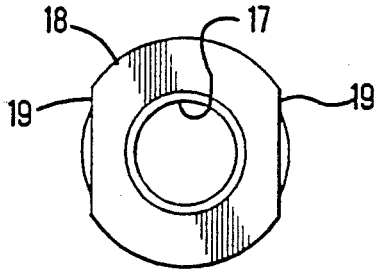
FIG. 14 is an end elevation view of the nut shown in FIG. 13.
Figure 15:
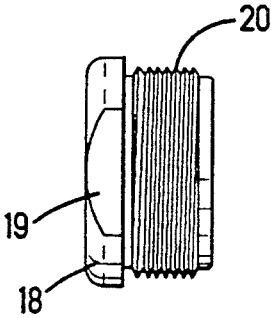
FIG. 15 is a side elevation view of the nut shown in FIG. 13.

With reference to FIGS. 13 through 15, the nut 10 is of unitary molded plastics construction, and includes a central bore 17 receiving the cable 2, an exterior end cap 18 provided with exterior flats 19 to receive a wrench, not shown, and exterior threads 20.

With reference to FIGS. 5 through 11, the housing 8 is of unitary molded plastics construction with a stepped axial bore 21, a rear end 22 with an internal threaded section 23, for threadably receiving the threads 20 of the nut 10, an internal rear facing interior shoulder 24, and axial slits 25 spaced circumferentially of a front end 26 and communicating with the bore 21. The slits 25 permit inward radial deflection of the lip 27 and the front end 26. A thickened cylindrical lip 27 with an exterior, frusto conical surface 27' tapers to the front end 26. A cylindrical groove 28 is in the exterior immediately to the rear of the lip 27. Exterior flat recesses 29 in a thickened cylindrical wall 30 to the rear of the groove 28 provides a tool rest for receiving a wrench tool, not shown, used to tighten the nut 10 threadable to the housing 8. At the front end 26, an interior, projecting key 31 is constructed for fabrication unitary with the housing 8, and has a construction suited for fabrication by a straight draw mold apparatus, not shown, with a one piece, molding core pin, not shown. The key 31 is unitary with the lip 27, and projects into the interior of the housing 8. The key 31 has a rear facing end 32 projecting into the interior of the housing 8, to facilitate molding by a one piece core pin having a first step reduced diameter to form the shoulder 24, and a second step of reduced dimension to form the key 31 unitary with the housing 8. After formation of the housing 8 around such a core pin, the core pin is readily withdrawn from front to rear of the housing 8. Accordingly, the construction of the housing 8 is suitable for mass production by repeated molding operations using such a core pin to form duplicate housings 8.

With reference to FIGS. 6 through 9, the coupling means 9 is of unitary molded plastics construction, and includes a cylindrical exterior provided with a series of recessed flutes 33 communicating with a front end 34, an internally threaded front section 35 for establishing a threaded connection to another, complementary connector, not shown, and an interior, projecting, circular lip 36. The lip 36 has an interference, or force, fit with the lip 27 of the housing 8, and is slidable over the lip 27 of the housing 8, as the lip 27 of the housing 8 deflects radially inward to permit passage of the coupling means 9 to a second position where the lip 36 enters the groove 28 and becomes interlocked against further movement front to rear. While the coupling means 9 is interlocked in the groove 8, it is also rotatable with respect to the housing 8 while interlocked in the groove 28, such that a threaded coupling can be established with a complementary connector, not shown, without rotation of the housing 8.

Figure 16:
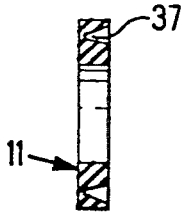
FIG. 16 is a section view of a gasket.
Figure 17:
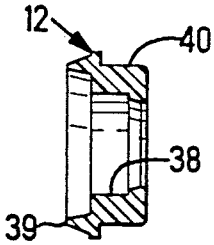
FIG. 17 is an elevation view in section of a clamp element.
Figure 18:
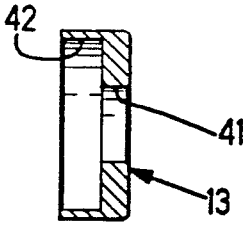
FIG. 18 is an elevation view in section of a sleeve element.

The gasket 11, FIG. 16, is fabricated of resilient rubber, and includes a circular groove 37, facing forward. The clamp element 12, FIG. 17, is fabricated of metal and includes an axial bore 38 to receive the cable 2, a rear facing ridge 39 for receipt in the groove 37 of the gasket 11, and a front facing cup 40. The sleeve element 13, FIG. 18, is fabricated of metal with an axial bore 41 receiving the cable 2, and a rear facing cup 42 that overlaps the cup 40 of the clamp element 12, as illustrated in FIG. 12.

Figure 19:
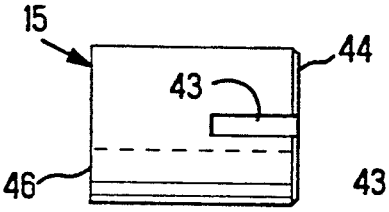
FIG. 19 is a plan view of a bottom of an insulator means of the connector shown in FIG. 1.
Figure 20:
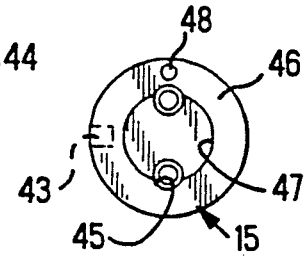
FIG. 20 is an end view of the insulator means shown in FIG. 19.
Figure 21:
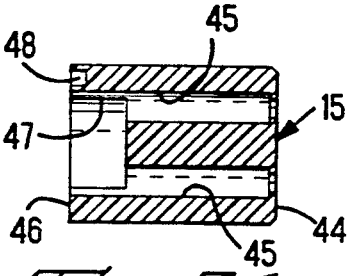
FIG. 21 is a section view of the insulator means shown in FIG. 19.

The insulator means 15, FIGS. 19 through 21, for example, is a unitary molded dielectric body having a cylindrical exterior provided with a .recessed keyway 43 communicating with a front end or face 44 and receiving the key 3, contact receiving cavities 45, 45 communicating with a rear end 46 and extending to the front end or face 44, and an axial recess 47 communicating with the rear end 46. An indentation 48 in the rear end 46 is adjacent to one of the cavities 45 to distinguish the same from the other cavity 45.

Figure 3:
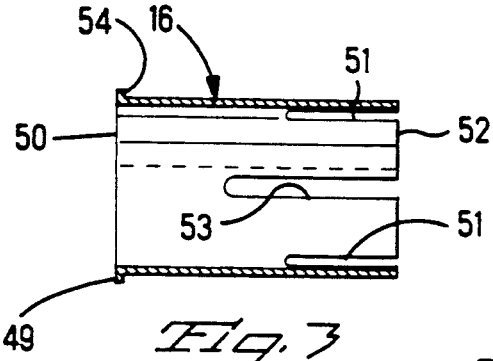
FIG. 3 is a side elevation view in section of a shell as shown in FIG. 10.
Figure 4:
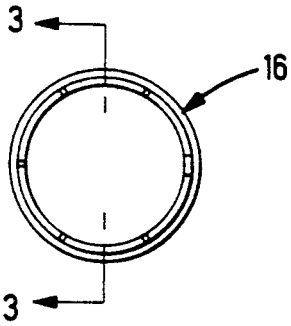
FIG. 4 is an end elevation view of a conductive shell of the connector shown in FIG. 3.
Figure 5:
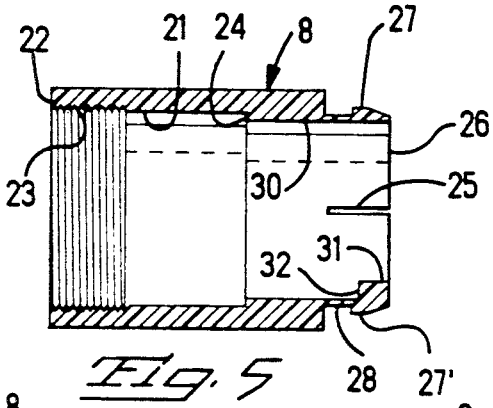
FIG. 5 is an elevation view of the housing shown in FIG. 10.
Figure 6:
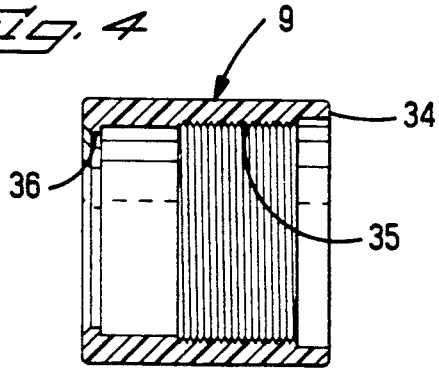
FIG. 6 is an elevation view in section of a nut shown in FIG. 8.
Figure 7:
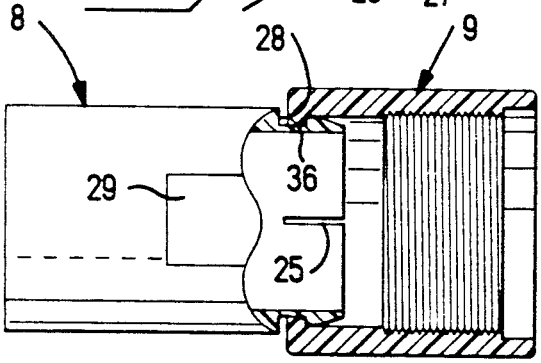
FIG. 7 is an elevation view partially in section of the housing and nut assembled.
Figure 8:
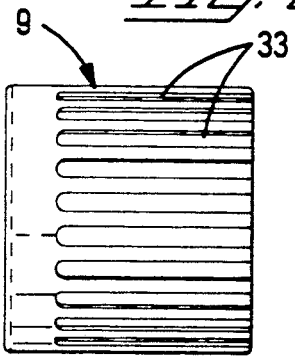
FIG. 8 is a side elevation view of the nut shown in FIG. 9.
Figure 9:
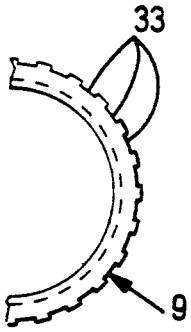
FIG. 9 is a partial end elevation view of an insulative nut of the connector shown in FIG. 1.
Figure 10:
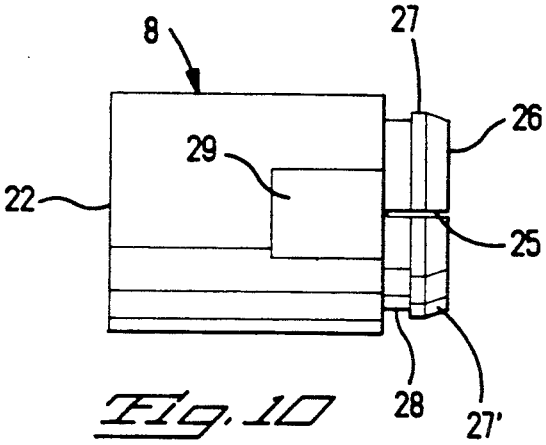
FIG. 10 is a side elevation view of an insulative housing of the connector shown in FIG. 1.
Figure 11:
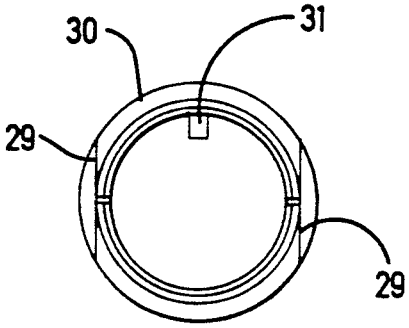
FIG. 11 is an end elevation view of the housing of the connector shown in FIG. 1.

The shell 16, FIGS. 3 and 4, is a unitary metal sleeve, formed by drawing. In the prior art, as represented by U.S. Pat. No. 4,804,339, it has been a common practice to have a conductive shell provided with a conductive key. The key was assembled to the shell, or was fabricated integral with the shell. A disadvantage of this construction was that the shell had to be fabricated by a relatively costly operation, such as machining, and by press fitting the key to the shell, or by machining the key integral with the shell. According to the invention, the key 31 is unitary with the insulative housing 8, permitting the shell 16 to be fabricated without a key, by a less costly operation, for example, metal drawing. The shell 16 has a construction suitable for fabrication by drawing. For example, the shell 16 has a constant cylindrical thickness, except for an external, projecting, cylindrical flange 49 at a rear end 50, formed during the drawing operation by subjecting only the front portion of the shell 16 to complete drawing into a cylindrical shape. A series of longitudinal slits 51 are circumferentially spaced about a cylindrical, front end 52, and communicate with the front end or face 52. The slits 51 permit the front end 52 to deflect resiliently and radially during coupling with a complementary connector, not shown. A keyway 53 extends longitudinally and communicates with the front end or face 52. The keyway 53 and the slits 51 are recessed in the thickness of the shell 16, and thereby do not interfere with formation of the shell 16 during the drawing operation.

Figure 12:
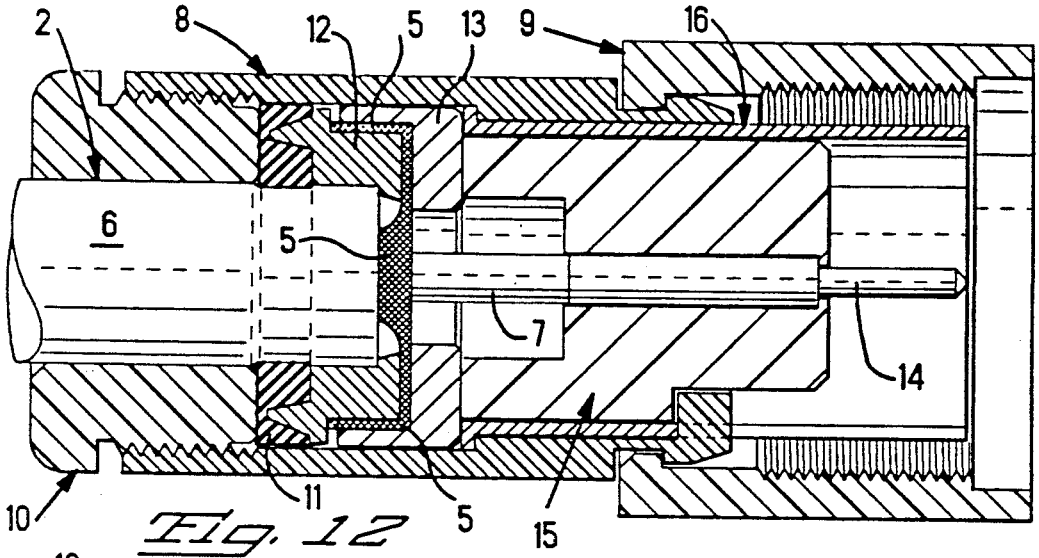
FIG. 12 is a side elevation of an assembly of the connector shown in FIG. 1.

Assembly of the connector 1 and the cable 2, FIGS. 2 and 12, involves passing the cable 2 successively through the nut 10, the gasket 11 and the clamp element 12, then doubling back the shield 5 over the cup 40 of the clamp element 12, then passing the cable 2 through the sleeve element 13, with the cups 40 and 42 overlapping each other and clamping the shield 5 to establish an electrical connection, assembling each contact 14 to a corresponding conductor 3, assembling each contact 14 along a corresponding cavity 45 of the insulator means 15 until the insulator means 15 engages the front of the sleeve element 13, and the contact 14 projects outward of the insulator means 15, and while the corresponding conductor 3 extends unimpeded across the recess 47. The shell 16 is assembled in the housing 8, with the keyway 53 receiving the key 31 and the front facing shoulder 54 of the flange 49 faces and engages the rear facing shoulder 24 of the housing 8. The shell 16 will project forward outward of the housing 8 for connection to a complementary connector, not shown. The means 9 will at all times cover the projecting portion of the shell 16.

We claim:

1. A connector comprising: conductive contact means for connection to corresponding signal conductor means of an electrical cable, a conductive shell, insulator means for separating the contact means and the conductive shell, an insulative housing covering the conductive shell and insulator means, an insulative coupling means for disconnectable coupling to a complementary connector, said insulative coupling means being adapted for assembly with the insulative housing by movement over a first inwardly deflectable portion of the insulative housing with an interference fit therewith to a position for rotation with respect to said insulative housing while interlocked with a second portion of said insulative housing, a conductive clamp and a conductive sleeve secured to opposite sides of a conductive shield of the cable, the conductive shield being electrically connected with a rear portion of the conductive shell by contact of the conductive sleeve with the conductive shell, and a front facing shoulder on the conductive shell facing a rear facing shoulder of the insulative housing.

2. A connector as recited in claim 1, comprising:

an insulative end cap receiving the cable and being secured to the insulative housing.

3. A connector comprising:

conductive contact means for connection to corresponding signal conductor means of an electrical cable, a conductive shell, insulator means for separating the contact means and the conductive shell, an insulative housing having an internal, unitary key, respective keyways of the conductive shell and the insulator means receiving the unitary key, and the conductive shell is fabricated by having been drawn into the shape of a cylinder with the keyway of the shell extending axially of the cylinder and communicating with a front face of the cylinder.

4. A connector as recited in claim 3, comprising:

insulative coupling means for disconnectable coupling to a complementary connector, said insulative coupling means being adapted for movement along a first portion of the insulative housing with an interference fit therewith to a position for rotation with respect to said insulative housing while interlocked with a second portion of said insulative housing.

5. A connector as recited in claim 3, comprising: the respective keyways communicating with respective front faces of the conductive shell and of the insulator means.

6. A connector as recited in claim 3, comprising: an insulative end cap receiving the cable and being secured to the insulative housing.

7. A connector comprising:

conductive contact means for connection to corresponding signal conductor means of an electrical cable, a conductive shell, insulator means for separating the contact means and the conductive shell, an insulative housing having an internal unitary key, the key being received in respective keyways in the conductive shell and in the insulator means, the respective keyways communicating with respective front faces of the conductive shell and of the insulator means, the insulative housing covering the conductive shell, and coupling means for rotation with respect to the insulative housing while interlocked with the insulative housing.

8. A connector as recited in claim 7 wherein, the coupling means enters a groove of the insulative housing and is rotatable while interlocked in the groove.

9. A connector as recited in claim 7 wherein, a first portion of the insulative housing is deflectable inward to permit passage of the coupling means over the first portion and to a second portion of the insulative housing, and the coupling means is rotatable while interlocked with the second portion.

* * * * *